US010714867B2

(12) United States Patent
Koyama et al.

(10) Patent No.: US 10,714,867 B2
(45) Date of Patent: Jul. 14, 2020

(54) WATERPROOF CONNECTOR

(71) Applicant: SMK Corporation, Tokyo (JP)

(72) Inventors: Yuki Koyama, Tokyo (JP); Kiyoshi Asai, Kanagawa (JP); Toshihiko Kato, Kanagawa (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 16/505,754

(22) Filed: Jul. 9, 2019

(65) Prior Publication Data

US 2020/0112120 A1 Apr. 9, 2020

(30) Foreign Application Priority Data

Oct. 9, 2018 (JP) ..... 2018-191058

(51) Int. Cl.
*H01R 13/52* (2006.01)

(52) U.S. Cl.
CPC ..... *H01R 13/5202* (2013.01)

(58) Field of Classification Search
CPC ..... H01R 13/5202; H01R 13/5219; H01R 13/5221; H01R 13/965
USPC ..... 439/271–277, 587, 660
See application file for complete search history.

(56) References Cited

U.S. PATENT DOCUMENTS

| | | | | |
|---|---|---|---|---|
| 9,525,236 | B2 * | 12/2016 | Lee | H01R 13/5202 |
| 9,553,410 | B2 * | 1/2017 | Zhao | H01R 12/724 |
| 10,446,972 | B2 * | 10/2019 | Ono | H01R 13/5216 |
| 2012/0315779 | A1 | 12/2012 | Yudate | |

* cited by examiner

*Primary Examiner* — Khiem M Nguyen

(57) ABSTRACT

A waterproof connector capable of maintaining high waterproof properties even under high water pressure is provided. The waterproof connector includes: a connector main body having connection terminals held by a housing; a casing having a connector accommodating portion in which the connector main body is accommodated; and a sealing material fixed to an outer peripheral portion of the housing and preventing water from entering between the housing and the casing. The sealing material includes a peripheral abutting portion configured to abut against an inner peripheral surface of the connector accommodating portion, and a rear abutting portion configured to abut against a rear wall portion of the connector accommodating portion, and the housing includes a sealing material supporting surface configured to support a rear surface portion of the rear abutting portion.

4 Claims, 7 Drawing Sheets

WATERPROOF CONNECTOR

CROSS REFERENCE TO RELATED APPLICATION

The contents of the following Japanese patent application are incorporated herein by reference, Japanese Patent Application No. 2018-191058 filed on Oct. 9, 2018.

FIELD

The present invention relates to a connector for use in electronic devices in accordance with a waterproof specification, and in particular to a waterproof connector that can be used even in a position deep in the water.

BACKGROUND

In recent years, portable communication terminals such as smartphones and electronic devices such as wristwatch-type terminals in accordance with waterproof specifications have been widely used, and such waterproof electronic devices are provided with waterproof connectors for connection with chargers and other devices (see, for example, Patent Literature 1).

The waterproof connector includes a connection terminal for connecting to a substrate or the like of an electronic device, and a connector main body for holding the terminal. The waterproof connecter is configured such that the connector main body is accommodated in a casing forming a housing of the electronic device, and a gap between the casing and the connector main body is sealed by a sealing material such as a packing fitted to an outer periphery of the connector main body.

CITATION LIST

Patent Literature

Patent Literature 1: Japanese Patent No 5155492.

SUMMARY

Technical Problem

However, in the conventional technique as described above, when the electronic device provided with the connector sinks in a position deep in the water and high water pressure acts on the electronic device, there is a concern that the connector main body is pressed by the water pressure and the connector main body is forced to move in a direction in which a gap is generated between the casing and the sealing material, so that water may enter the inside of the casing.

In addition, in such a waterproof connector, when high waterproof properties are required, countermeasures such as a plurality of sealing materials or increasing the compression amount of the sealing materials are required, and accordingly, there are problems such as enlargement of the connector and deterioration of workability at the time of installation.

The present invention has been made in view of the above-described conventional problems, and an object thereof is to provide a waterproof connector capable of maintaining high waterproof properties even under high water pressure.

Solution to Problem

In order to solve the above-mentioned conventional problems, a first aspect of the present invention is a waterproof connector including: a connector main body having a connection terminal held by a housing; a casing having a connector accommodating portion in a concave hole shape in which the connector main body is accommodated; and a sealing material fixed to an outer peripheral portion of the housing and preventing water from entering between the housing and the casing. In this waterproof connector, the sealing material includes a peripheral abutting portion configured to abut against an inner peripheral surface of the connector accommodating portion, and a rear abutting portion configured to abut against a rear wall portion of the connector accommodating portion, and the housing includes a sealing material supporting surface configured to support a rear surface portion of the rear abutting portion.

In a second aspect of the present invention, in addition to the configuration according to the first aspect, the waterproof connector is configured such that the rear side abutting portion includes a plurality of contact convex portions having a convex cross-sectional shape, and a groove-like deformation absorbing portion formed between the contact convex portions.

In a third aspect of the present invention, in addition to the configuration according to the first or second aspect, the waterproof connector is configured such that the connection terminal is formed in a stepped pin shape having a large diameter portion and a small diameter portion successively formed in the axial direction. The connection terminal is inserted into the housing from the front side of the housing, and the small diameter portion protrudes from an end surface of the housing and is inserted through an insertion hole formed in any of the rear wall portion and a support plate portion supported on the rear wall portion on a rear surface side, and is locked to an opening edge portion of the insertion hole by a retainer member fixed to the tip of the small diameter portion, so that the connector main body is prevented from coming out from the casing by the retainer member.

In a fourth aspect of the present invention, in addition to the configuration according to any one of the first to third aspects, the waterproof connector is configured such that the sealing material is integrally molded with the housing by a liquid silicone rubber material.

Since the waterproof connector has the configuration according to the first aspect, the sealing material can abut against the inner peripheral surface and the rear wall portion of the connector accommodating portion to exhibit high waterproof properties, and even when the electronic device provided with the connector sinks to a position deep in the water and high water pressure is applied to the casing, the sealing material is further compressed to maintain the high waterproof properties.

In addition, since the waterproof connector has the configuration according to the first second, the groove-like deformation absorbing portion formed between the contact convex portions can serve as a deformation margin of the contact convex portions to allow deformation in the compression direction.

In addition, since the waterproof connector has the configuration according to the third second, a slight amount of thrust is secured in the direction in which the sealing material is further compressed, and when water pressure is applied to the connector main body, the contact terminals press the housing in the direction in which the sealing material is compressed, to exert high waterproof properties.

In addition, since the waterproof connector has the configuration according to the fourth second, the degree of freedom of shape designing is increased, and the mounting operation is facilitated, and the connector can be miniaturized.

DESCRIPTION OF EMBODIMENTS

Figure 1A:
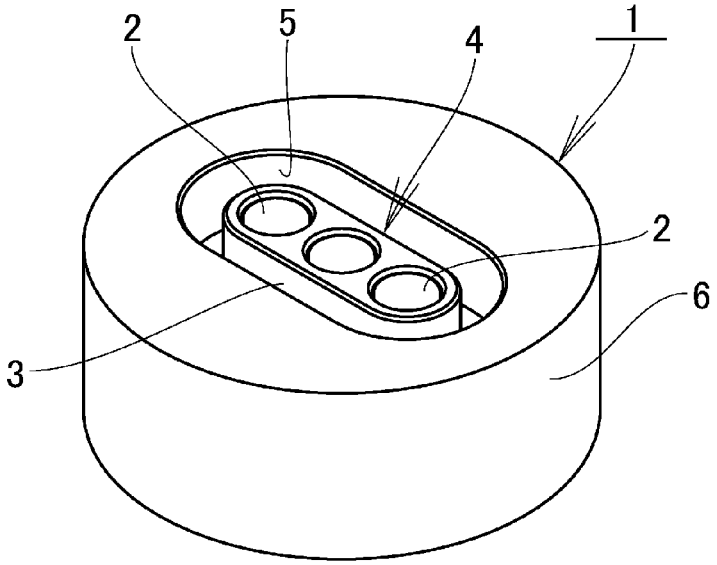
FIG. 1A is a perspective view, showing an example of the use mode of a waterproof connector according to an embodiment of the present invention, seen from the opening side.
Figure 1B:
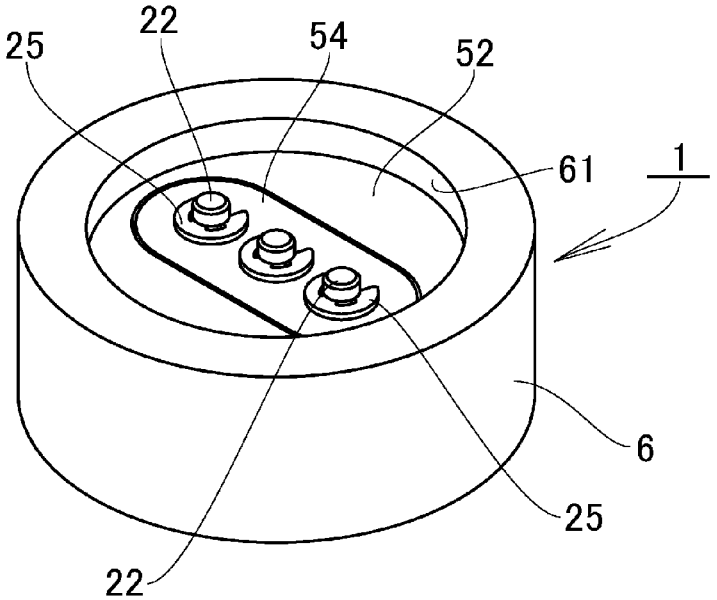
FIG. 1B is a perspective view, showing an example of the use mode of the waterproof connector according to the embodiment of the present invention, seen from the rear side.
Figure 2:
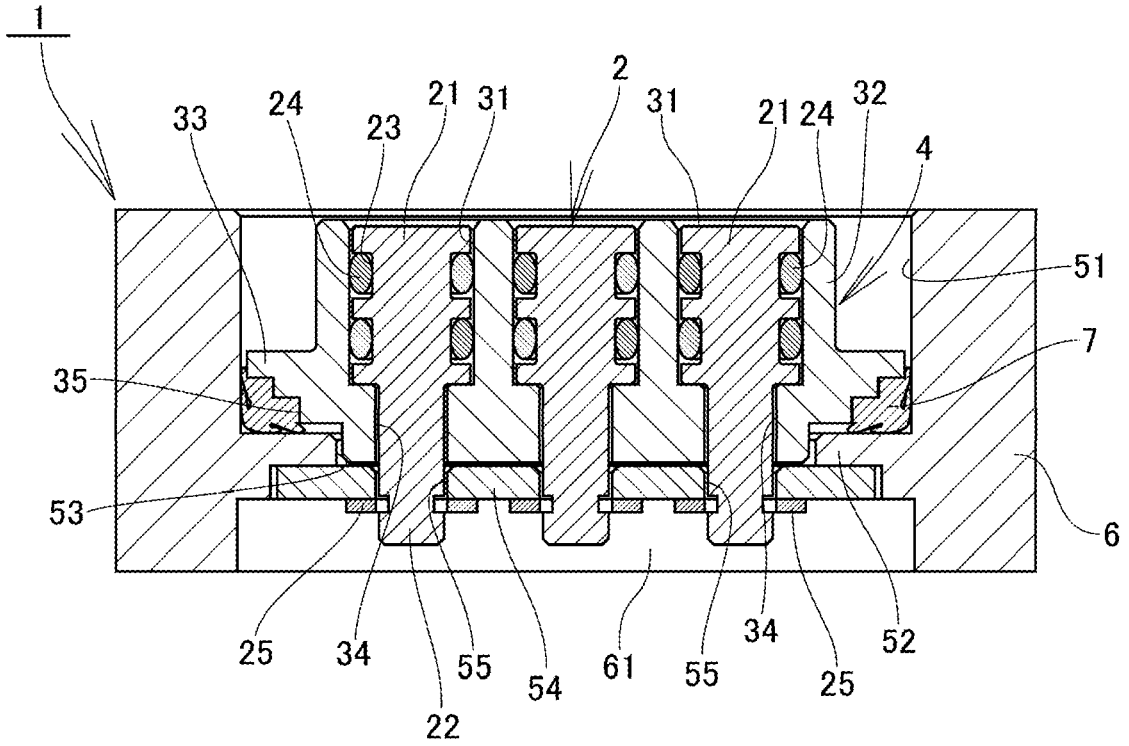
FIG. 2 is a cross-sectional view of the waterproof connector.
Figure 3:
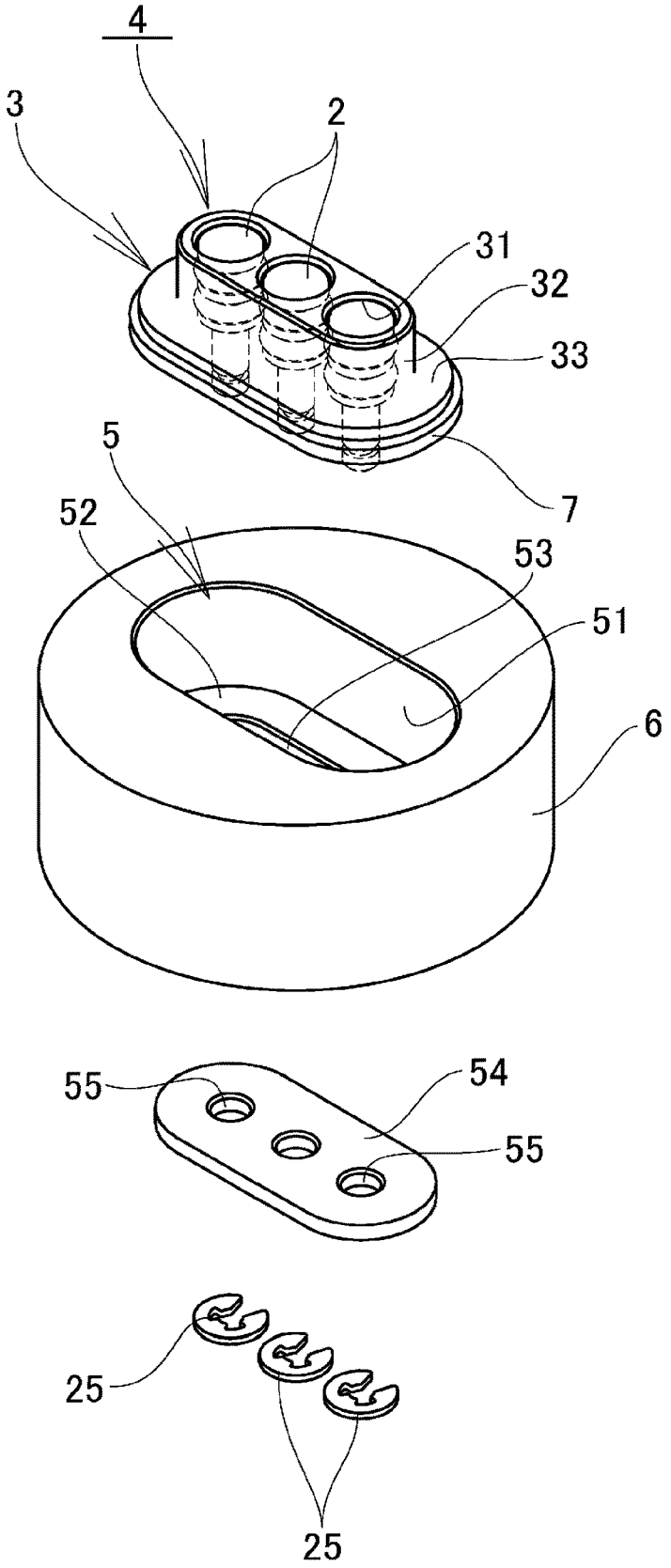
FIG. 3 is an exploded perspective view of the waterproof connector.
Figure 4:
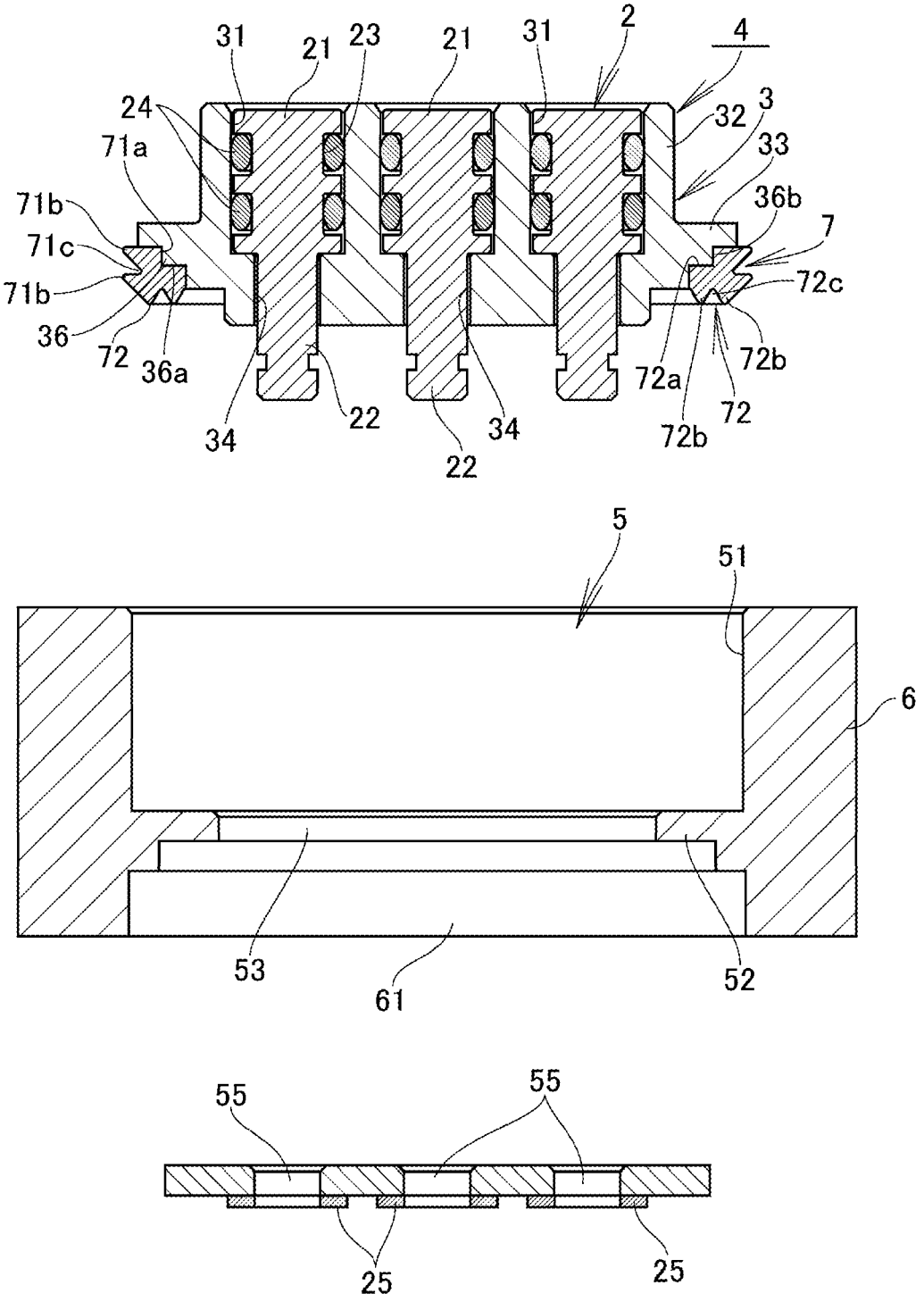
FIG. 4 is an exploded cross-sectional view of the waterproof connector.
Figure 5A:
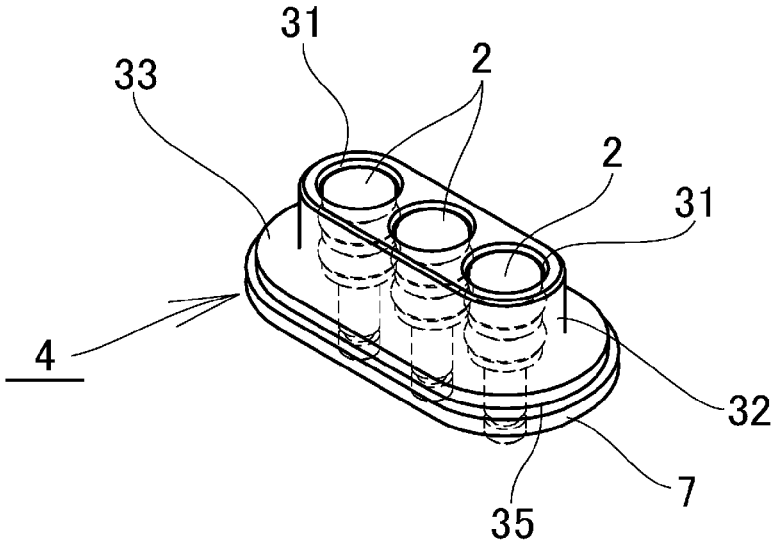
FIG. 5A is a perspective view from the opening side, showing a connector main body in FIGS. 1A and 1B.
Figure 5B:
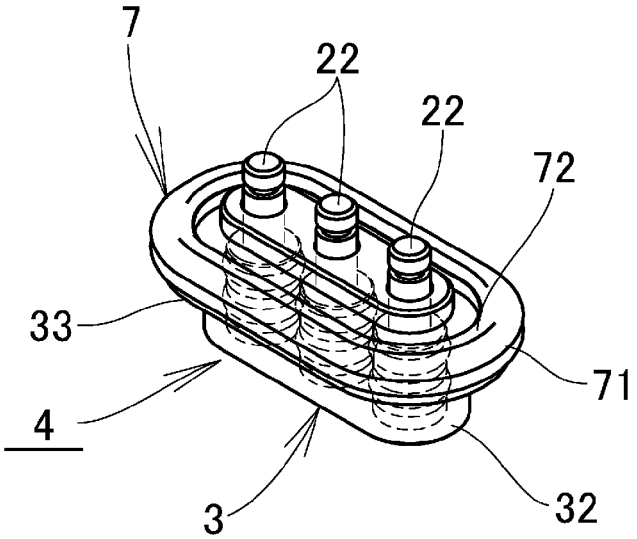
FIG. 5B is a perspective view from the rear side, showing the connector main body in FIGS. 1A and 1B.
Figure 6A:
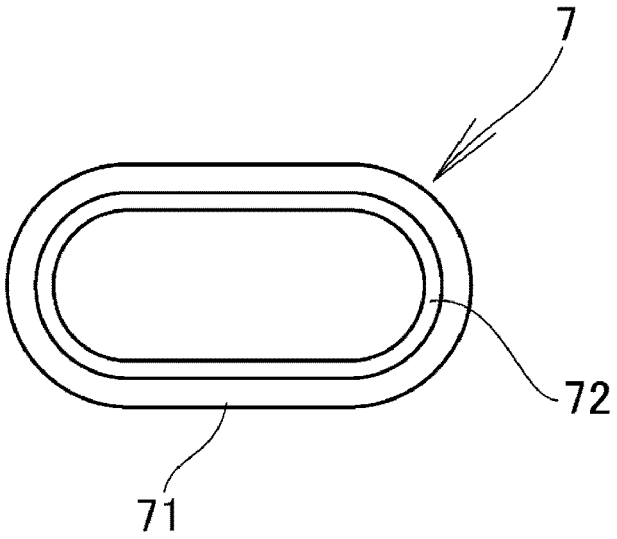
FIG. 6A is a plan view showing a sealing material in FIGS. 5A and 5B.
Figure 6B:
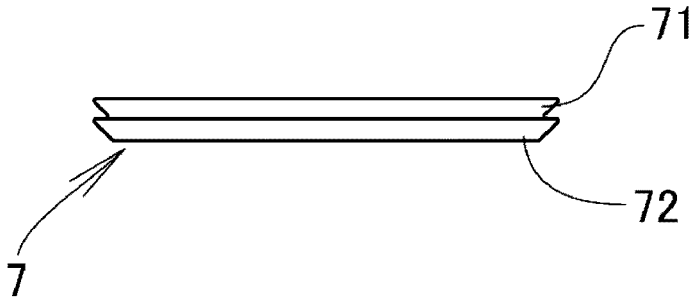
FIG. 6B is a front view of the sealing material.
Figure 6C:
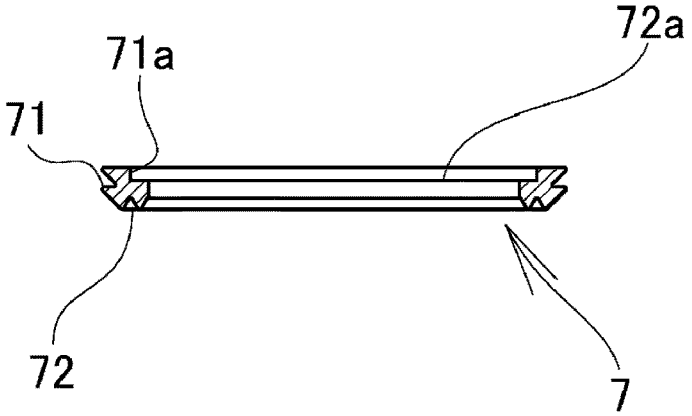
FIG. 6C is a cross-sectional view of a waterproof material of the sealing material.
Figure 6D:
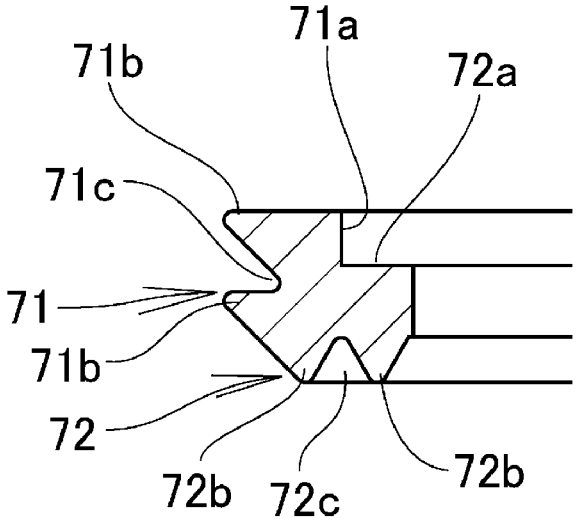
FIG. 6D is an enlarged cross-sectional view of the sealing material.

Next, an embodiment of a waterproof connector according to the present invention will be described by way of examples shown in FIGS. 1 to 6D. Reference numeral 1 in the drawing denotes a waterproof connector.

The waterproof connector 1 includes a connector main body 4 in which connection terminals 2 are held in a housing 3, a casing 6 having a connector accommodating portion 5 in a concave hole shape in which the connector main body 4 is accommodated, and a sealing member 7 fixed to an outer peripheral portion of the housing 3, and water is prevented from entering between the housing 3 and the casing 6 by the sealing member 7.

The casing 6 includes the concave connector accommodating portion 5 opened to the front side, and the connector main body 4 is inserted from the front side of the connector accommodating portion 5.

In the connector accommodating portion 5, a rear wall portion 52 is formed on the deeper side of the inner peripheral surface 51, so that the interior of the connector accommodating portion 5 and a casing interior 61 are separated from each other by the rear wall portion 52. In this structure, the connector main body 4 is inserted from the opening side toward the rear wall portion 52 side and abuts against, and is fixed to, the rear wall portion 52.

The rear wall portion 52 has a housing insertion hole 53 in which part of the housing 3 is inserted in the center portion. A plate-like support plate portion 54 is fixed to an opening edge portion of the housing insertion hole 53 on the rear surface side, that is, on the case interior 61 side.

The support plate portion 54 is provided with a plurality of insertion holes 55 at predetermined intervals. A small diameter portion 22 of the connection terminal 2 described later is inserted through each of the insertion holes 55 and the tip end of the small diameter portion 22 is fixed with a retainer member 25, which is locked to the opening edge portion of the insertion hole 55. In this manner the connector main body 4 is prevented from coming out of the casing 6.

The connector main body 4 includes a housing 3 made of a resin, pin-shaped connection terminals 2 accommodated in the housing 3, and a sealing material 7 fixed to an outer peripheral portion of the housing 3.

The connection terminal 2 is formed of a conductive metal material and has a cylindrical large diameter portion 21, and the small diameter portion 22 successively formed in the axial direction 21, so that the connection terminal 2 has a stepped pin shape having a stepped portion at the boundary between the large diameter portion 21 and the small diameter portion 22.

The large diameter portion 21 is provided with a plurality of circumferentially continuous sealing grooves 23 formed around the outer peripheral portion thereof, and a terminal sealing material 24 such as an O-ring or the like is fitted in each of the sealing grooves 23.

The small-diameter portion 22 is formed in a cylindrical shape having a smaller diameter than that of the large-diameter portion 21, and is successively formed in the axial direction in a coaxial arrangement with the large-diameter portion 21.

The retaining member 25 such as an e-ring or the like is engaged with the distal end portion of the small diameter portion 22.

The housing 3 is formed of an insulating resin material, and includes a main body portion 32 opened on the front surface side and having terminal insertion portions 31 into which the connection terminals 2 are inserted, and a flange portion 33 protruding from the outer peripheral portion of the main body portion 32.

Each of the terminal insertion portions 31 is formed in a circular hole opened on one end side (front surface side) of the main body portion 32, and has a through hole 34, through which the small diameter portion 22 of the connection terminal 2 passes, on the rear end side so that the tip of the small diameter portion 22 protrudes from the rear end side of the main body portion 32 through the through hole 34.

The flange portion 33 is formed in a shape projecting in a flange shape from the outer periphery of the main body portion 32 in accordance with the inner peripheral surface of the connector accommodating portion 5. The outer peripheral surface thereof is fitted into the connector accommodating portion 5 with a slight gap therebetween on the inner peripheral side thereof.

In addition, the flange portion 33 is provided with a sealing material holding portion 35 to which the sealing material 7 is fixed at the outer peripheral portion on the rear surface side thereof, so that the sealing material 7 fixed to the sealing material holding portion 35 abuts against the inner peripheral surface and the rear wall portion 52 of the connector accommodating portion 5.

The sealing material holding portion 35 is provided with a step portion 36 successively formed in the peripheral direction, and the rear surface of the step portion 36 serves as a rear side sealing material supporting surface 36*a* for supporting the rear surface portion of a rear abutting portion 72 of the sealing material 7, which will be described later, and the side surface of the step portion 36 serves as a sealing material supporting surface 36*b* for supporting a peripheral abutting portion 71 of the sealing material 7.

The sealing material 7 includes the peripheral abutting portion 71 configured to abut against the inner peripheral surface 51 of the connector accommodating portion 5 and the rear abutting portion 72 configured to abut against the rear wall portion 52 of the connector accommodating portion 5. Thus, the peripheral abutting portion 71 and the rear abutting portion 72 arranged in an L-shape collectively have a continuous annular cross section over the entire periphery of the flange portion 33.

The rear abutting portion 72 has a flat supporting surface 72*a* on the flange portion side, and includes a plurality of (in this embodiment, a pair of) contact convex portions 72*b* having a convex cross-sectional shape on the rear wall portion 52 side, and a groove-like deformation absorbing portion 72*c* formed between the contact convex portions 72*b* and 72*b*, and thus has a corrugated cross-sectional shape.

The peripheral abutting portion 71 has a flat supporting surface 71*a* on the inner side, and includes a plurality of (in this embodiment, a pair of) contact convex portions 71*b* having a convex cross-sectional shape on the outer side, and a groove-like deformation absorbing portion 71*c* formed between the contact convex portions 71*b* and 71*b*, and thus has a corrugated cross-sectional shape.

The sealing material 7 may be integrally molded with the housing 3 by a liquid silicone rubber material, and thus, even if it is small, the rear abutting portion 72 and the peripheral abutting portion 71 can be formed in the corrugated cross-sectional shape including the plurality of (in this embodiment, a pair of) contact convex portions 72*b* (71*b*), and the groove-like deformation absorbing portion 72*c* (71*c*) formed between the contact convex portions 72*b* and 72*b* (71*b* and 71*b*).

In this waterproof connector 1, the connection terminals 2 are inserted into the respective terminal insertion portions 31 of the housing 3, so that the large diameter portion 21 is fitted into the terminal insertion portion 31, and the small diameter portion 22 is incorporated in a state of protruding from the end portion of the housing 3.

The terminal sealing material 24 is interposed between the outer periphery of the large diameter portion 21 and the inner peripheral surface of the terminal insertion portion 31, so that water is prevented from entering between the housing 3 and the connection terminals 2.

In the waterproof connector 1 with the above-described configuration, when the connector main body 4 is inserted into the connector accommodating portion 5 from the opening side and the flange portion 33 of the housing 3 is inserted into the position where the flange portion 33 abuts against the rear wall portion 52, the small diameter portions 22 of the connection terminals 2 pass through the respective insertion holes 55 of the support plate portion 54. Then, the small diameter portions 22 are fixed with the retainer members 25 such as e-rings, to be locked to the opening edge portions of the respective insertion holes 55 by the retainer members 25. Thus, the housing 3 and the respective connection terminals 2 constituting the connector main body 4 are prevented from coming out of the rear wall portion 52 of the casing 6 in a state allowing a slight amount of thrust.

In this state, the peripheral abutting portion 71 of the sealing member 7 abuts against the inner peripheral surface of the connector accommodation portion 5 in a compressed state, while the rear abutting portion 72 abuts against the rear wall portion 52 of the connector accommodating portion 5 in a compressed state, so that water is prevented from entering between the connector main body 4 and the casing 6.

The waterproof connector 1 configured in this manner is in a state in which the peripheral abutting portion 71 of the sealing material 7 abuts against the inner peripheral surface of the connector housing portion 5 and the rear abutting portion 72 abuts against the rear wall portion 52 of the connector housing portion 5 even under normal conditions, and is thus kept watertight.

On the other hand, when the electronic device having the waterproof connector 1 sinks to a position deep in the water and high water pressure is applied thereto, the housing 3 is pressed to the rear side of the casing 6 by the water pressure, and the rear surface portion of the rear abutting portion 72 is compressed in a state of being supported by the sealing material supporting surface 36*a*.

At this time, the sealing material 7 has a corrugated cross-sectional shape formed by the rear abutting portion 72 and the peripheral abutting portion 71 including the plurality of (in this embodiment, a pair of) contact convex portions 72*b* (71*b*) having a convex cross-sectional shape and the groove-like deformation absorbing portion 72*c* (71*c*) formed between the contact convex portions 72*b* and 72*b* (71*b* and 71*b*), so that the contact convex portions 72*b* (71*b*) can be suitably elastically deformed by using the deformation absorbing portion 72*c* (71*c*) as a deformation margin, thereby exhibiting high watertight properties.

Further, in the waterproof connector 1, since the connection terminals 2 are formed in a stepped pin shape, when a situation is reached in which high water pressure is applied, the water pressure presses the connection terminals 2 toward the rear side, and the large diameter portions 21 press the housing 3. This can further press the rear abutting portion 72 of the sealing member 7 against the rear wall portion 52 side, so that the sealing member 7 is further compressed.

Incidentally, in the embodiment described above, the case where the waterproof material is integrally molded with the housing 3 by the liquid silicone rubber material has been described, but the waterproof material may be formed separately from the housing 3 by an elastic member such as a rubber material and may be incorporated in the housing 3.

In addition, the form of the casing 6 is not limited to the above-described embodiment, and can be freely made to have a shape suited to a housing or the like of an electronic device to be used.

Further, in the above embodiment, an example in which the rear wall portion 52 and the support plate portion 54 are provided separately has been described, but the support plate portion 54 may be formed integrally with the rear wall portion 52.

REFERENCE SIGNS LIST

1 waterproof connector
2 connection terminal
21 large diameter portion
22 small diameter portion
23 sealing groove
24 terminal sealing material
25 retainer member
3 housing
31 terminal insertion portion
32 main body portion
33 flange portion
34 through hole
35 sealing material holding portion

36 step portion
4 connector main body
5 connector accommodating portion
51 inner peripheral surface
52 rear wall portion
53 housing insertion hole
54 support plate portion
55 insertion hole
6 casing
61 casing interior
7 sealing member
71 peripheral abutting portion
72 rear abutting portion

The invention claimed is:

1. A waterproof connector comprising:

a connector main body having a connection terminal held by a housing;

a casing having a connector accommodating portion in a concave hole shape in which the connector main body is accommodated; and a sealing material fixed to an outer peripheral portion of the housing and preventing water from entering between the housing and the casing, wherein the sealing material includes a peripheral abutting portion configured to abut against an inner peripheral surface of the connector accommodating portion, and a rear abutting portion configured to abut against a rear wall portion of the connector accommodating portion, and the housing includes a sealing material supporting surface configured to support a rear surface portion of the rear abutting portion.

2. The waterproof connector according to claim 1, wherein the rear side abutting portion includes a plurality of contact convex portions having a convex cross-sectional shape, and a groove-like deformation absorbing portion formed between the contact convex portions.

3. The waterproof connector according to claim 1, wherein the connection terminal is formed in a stepped pin shape having a large diameter portion and a small diameter portion successively formed in the axial direction, the connection terminal is inserted into the housing from the front side of the housing, and the small diameter portion protrudes from an end surface of the housing and is inserted through an insertion hole formed in any of the rear wall portion and a support plate portion supported on the rear wall portion on a rear surface side, and is locked to an opening edge portion of the insertion hole by a retainer member fixed to the tip of the small diameter portion, so that the connector main body is prevented from coming out from the casing by the retainer member.

4. The waterproof connector according to claim 1, wherein the sealing material is integrally molded with the housing by a liquid silicone rubber material.

* * * * *